United States Patent [19]

Masaoka et al.

[11] Patent Number: 5,061,155

[45] Date of Patent: Oct. 29, 1991

[54] ROTARY SWASH PLATE TYPE AXIAL PLUNGER PUMP

[75] Inventors: Toshika Masaoka, Toyota; Shigeki Komeiji, Okazaki, both of Japan

[73] Assignee: Toyota Jidosha Kabushiki Kaisha, Toyota, Japan

[21] Appl. No.: 556,642

[22] Filed: Jul. 20, 1990

[30] Foreign Application Priority Data

Jul. 24, 1989 [JP] Japan ..... 1-85631[U]

[51] Int. Cl.[5] ..... F04B 1/12; F04B 49/00

[52] U.S. Cl. ..... 417/269; 417/214

[58] Field of Search ..... 417/214, 269; 92/13

[56] References Cited

U.S. PATENT DOCUMENTS

| | | | |
|---|---|---|---|
| 2,439,879 | 4/1948 | Allen | 417/269 |
| 2,633,802 | 4/1953 | Parilla | 92/13 |
| 2,945,449 | 6/1960 | Febvre | 92/13 |
| 3,033,047 | 5/1962 | Uchida | 92/13 |
| 3,249,052 | 5/1966 | Karlak | 417/269 |
| 3,712,758 | 11/1973 | Lech | 417/214 |

FOREIGN PATENT DOCUMENTS

| | | |
|---|---|---|
| 58-15665 | 3/1983 | Japan . |
| 63-61779 | 3/1988 | Japan . |

*Primary Examiner*—Richard A. Bertsch
*Assistant Examiner*—Peter Korytnyk
*Attorney, Agent, or Firm*—Kenyon & Kenyon

[57] ABSTRACT

In axial plunger pump of the type wherein a swash plate is rotated while a cylinder body is kept stationary, plungers are axially slidably inserted into respective cylinder bores in the cylinder body, and the rotating swash plate cooperates with the plungers to obtain an axial stroke movement thereof for a pump operation. A stopper member is provided for cooperation with the plungers so that the stroke movement of the plunger in a direction toward the swash plate is limited. An actuator is provided for controlling an axial position of the stopper plate for obtaining desired variations of the effective stroke of the plungers.

9 Claims, 7 Drawing Sheets

ROTARY SWASH PLATE TYPE AXIAL PLUNGER PUMP

BACKGROUND OF THE INVENTION

1. Field of the Invention

The present invention relates to a rotary swash plate type of axial pump provided with plungers which are forced to execute a stroke movement by a rotary swash plate which is rotated together with a drive shaft, and more particularly, to a device for controlling the amount of the stroke of the plunger in such a type of pump.

2. Description of the Related Art

Two types of axial plunger pump, a rotary swash plate type (see, for example, Japanese Unexamined Patent Publication No. 63-61779) and a fixed swash plate type (see, for example, Japanese Unexamined Utility Model Publication No. 58-15665) are known. In the rotary swash plate type axial pump, a cylinder block in which plungers are slidably accommodated is stationary while a swash plate is rotated. Conversely, in a fixed swash plate type, the cylinder block is rotated while the swash plate is stationary. To vary the output of the pump, the angle of the swash plate can be varied for both the rotary swash plate pump and the fixed swash plate type pump.

The most important advantage of the rotary swash plate type pump over the fixed swash plate type pump is that, because the massive cylinder is not rotated, the inertia of the moving part of the pump is reduced, which allows the upper limit of the rotational speed of the pump to be increased and wear of the moving parts to be reduced, thus prolonging the service life of the pump. In the rotary type pump, the mechanism for controlling the output rate controls the angular position of the rotating swash plate, and therefore, some of the parts used for controlling this angular position rotate together with the swash plate, and thus these parts are soon worn. Furthermore, the construction is complicated because these parts must be rotated while executing the functions of controlling the angular position of the swash plate, but the alignment of the parts is easily lost due to the resulting wear, and thus the precision of the control is also easily lost.

SUMMARY OF THE INVENTION

An object of the present invention is to provide an axial plunger pump, wherein the mechanism for controlling the output of the fluid is separated from the swash plate, whereby the construction thereof is simplified.

Therefore, according to the present invention, there is provided an axial plunger pump comprising:

a stationary body, and a shaft rotatably arranged in the stationary body;

said body defining cylinder bores which are circumferentially spaced about an axis of the shaft, each cylinder bore defining an axis which is parallel to the axis of the shaft;

plungers axially and slidably inserted to the respective cylinder bores, so that pump chambers are formed on one side of the plungers in the respective cylinder bores, a swash plate mounted on the shaft and defining a operating surface inclined with respect to the axis of the shaft, the ends of the plunger remote from the respective pump chamber coming into contact with the operating surface so that the plungers are axially moved between opposite extreme positions to thereby vary the volume of the chamber;

means for allowing a fluid to be introduced into the operating chamber when the plungers are moved in a direction in which a volume of the pump chamber is increased, means for allowing the fluid to be discharged from the operating chamber when the plungers are moved in an opposite direction in which the volume of the pump chamber is decreased, and;

means for limiting the extreme positions of the plungers adjacent to the swash plate, to thereby vary the amount of fluid discharged from the pump chambers.

BRIEF DESCRIPTION OF ATTACHED DRAWINGS

DESCRIPTION OF THE PREFERRED EMBODIMENTS

Figure 1:
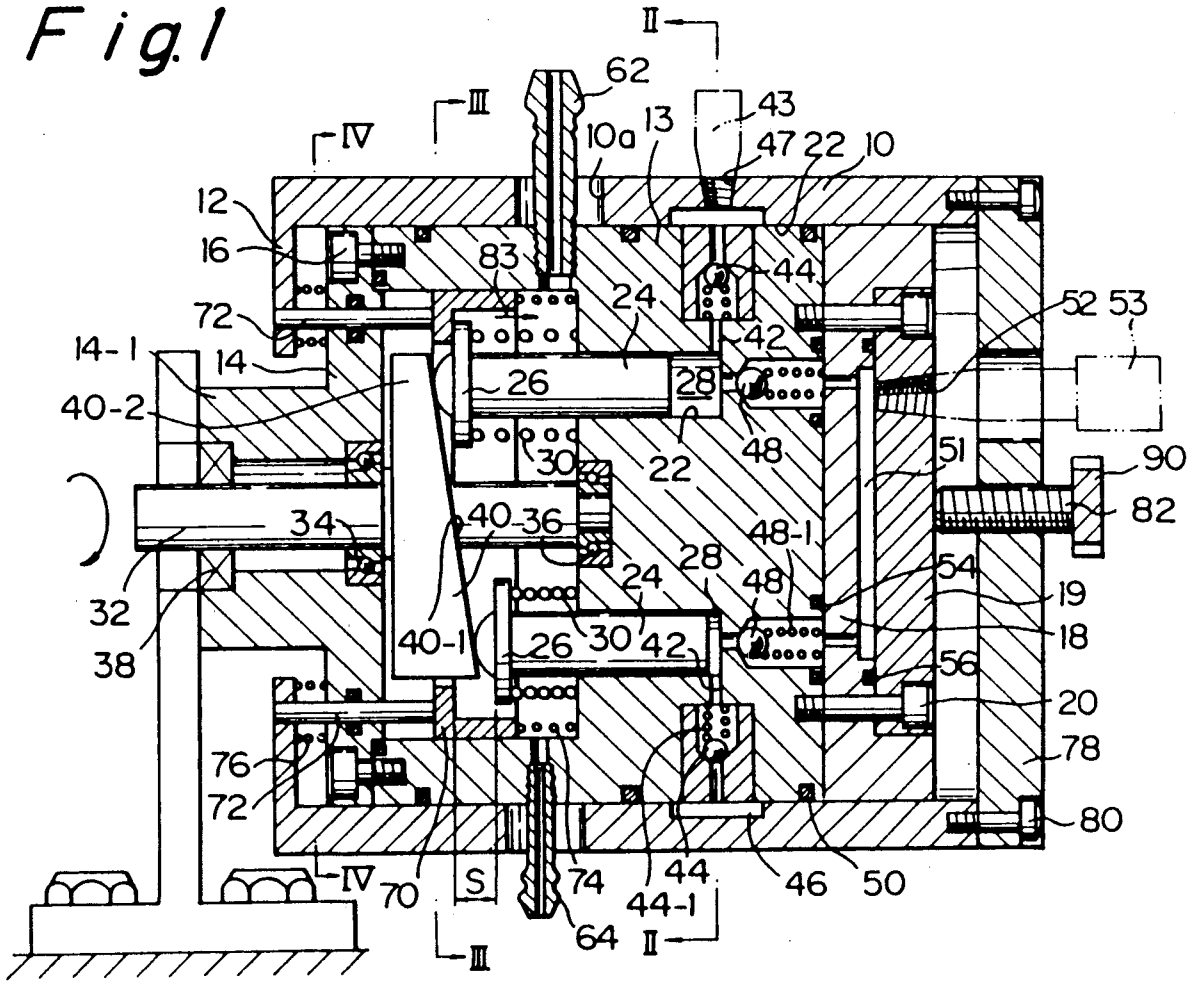
FIG. 1 is an side sectional view of a plunger pump according to the present invention.
Figure 2:
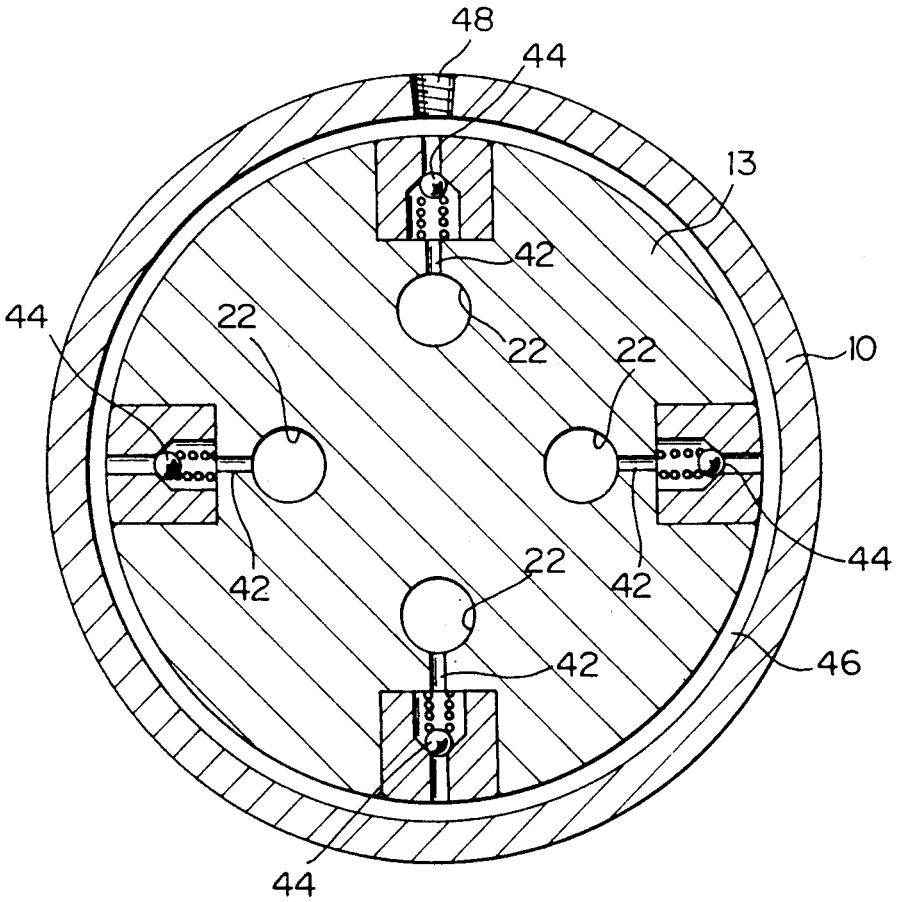
FIG. 2 is a transverse cross sectional view taken along the line II—II in FIG. 1.
Figure 3:
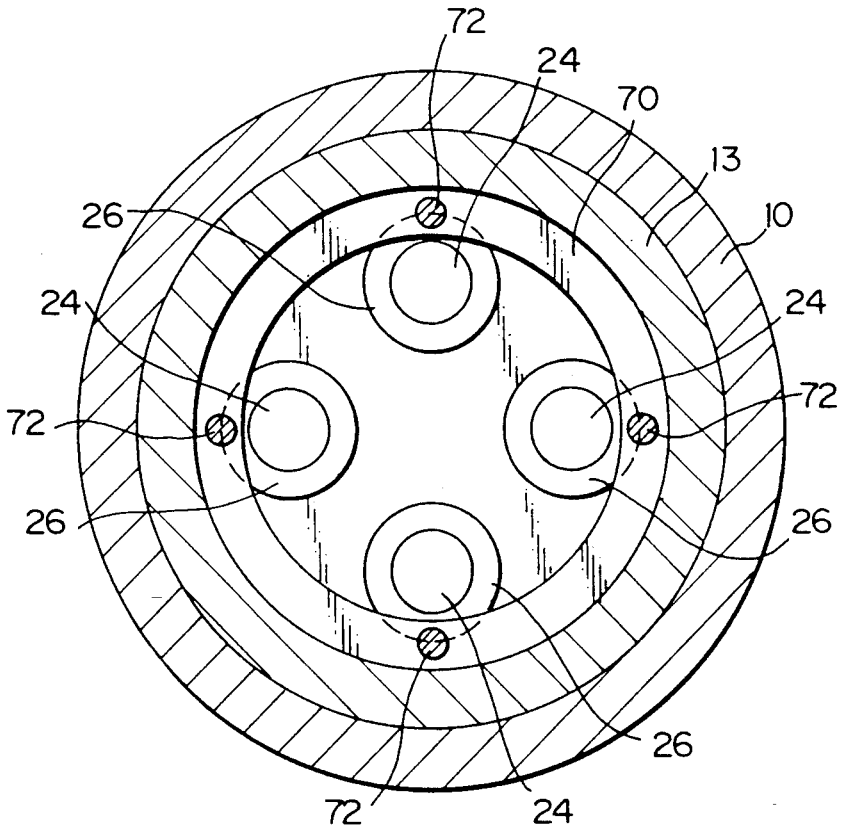
FIG. 3 is a transverse cross sectional view taken along the line III—III in FIG. 1.
Figure 4:
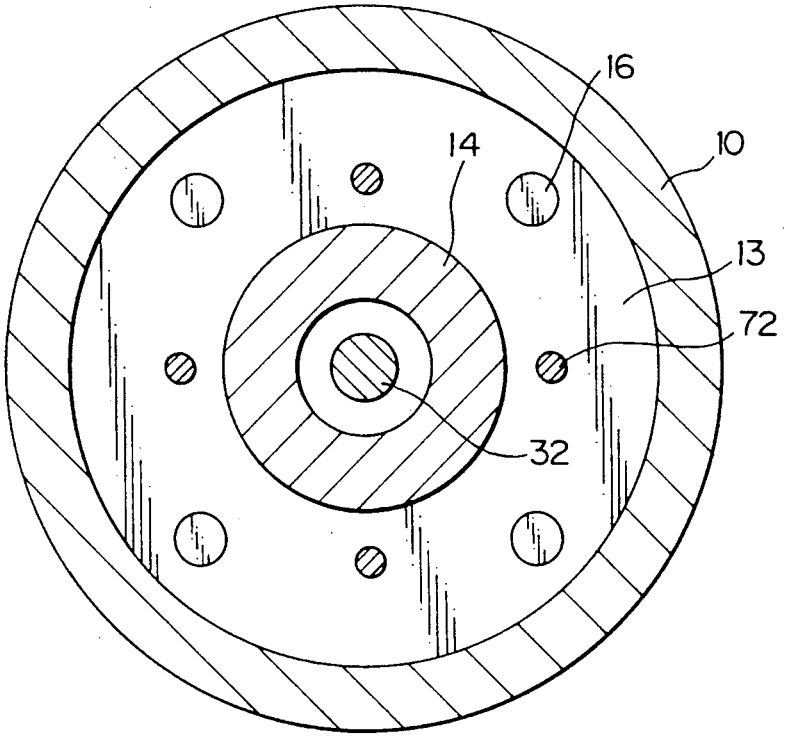
FIG. 4 is a transverse cross sectional view taken along the line IV—IV in FIG. 1.

In FIG. 1, showing a first embodiment of an axial pump according to the present invention, 10 denotes a longitudinally extended tubular housing having a radially extended annular flange 12 formed at one axial end thereof. A cylinder body 13 is inserted into the tubular housing 10, and a bearing plate 14 is mounted to one end of the cylinder body 13 adjacent to the flange portion 12, by bolts 16. A closure plate 18, together with an end disk 19, is connected to the other end of the cylinder body 13, by bolts 20. The cylinder body 13 has four equiangulary spaced cylinder bores 22 formed therein in the circumferential direction as shown in FIG. 2, and a plunger 24 is axially and slidably inserted to each of the cylinder bores 22 in a direction parallel to the axis of the pump. Each of the plungers 24 has a flange portion 26 formed at one end thereof, and a pump chamber 28 is formed on the other end of the each plunger 24, in the respective cylinder bore 22. A spring 30 is arranged between each of the flange portions 26 of the respective plungers 24 and the cylinder body 13, and biases each respective plunger 24 so that the volume of the pump chamber 28 is increased. The cylinder body 13 is slidable with respect to the housing 10, and has a drive shaft 32 having one end thereof rotatably connected to the bearing plate 14 by a bearing 34. The other end of the shaft 32 is rotatably supported on the cylinder body 13 by a bearing 36. A seal assembly 38 is arranged between an outer surface of the rotating shaft 32 and an inner surface of a boss portion 14-1 of the bearing plate 14 outside of the bearing 34, and a swash plate 40 is connected integrally to the shaft 32 and forms, on the side thereof facing the plungers, an inclined surface 40-1 with which ends of the plungers 24 remote from the respective pump chambers 28 are in contact.

Circumferentially spaced induction ports 42 are formed in the cylinder body 13, and are open to the inner wall of the cylinder bore 22. The induction ports 42 are opened to the respective pump chambers 28, and are connected to respective induction valves 44 connected to an annular groove 46 (FIG. 2) formed on the inner surface of the housing 10. An oil feed port 48 formed in the housing 10 is opened to the annular groove 46. This oil feed port 48 is connected to a oil source (not shown). The cylinder body 13 is provided with a pair of axially spaced annular recesses astride the annular grooves 46, and respective O-rings 50 are arranged in these annular recesses to provide a sealing contact with the inner surface of the housing 10, so that oil flowing from the annular groove 46 to the check valves 44 does not leak outside. The pump chambers 28 of the plungers 24 are connected, via respective delivery valves 48, to a common delivery chamber 51 formed between the end plate 18 and the end disk 19. The end disk 19 forms a delivery port 52 which is open to the delivery chamber 51. A pair of concentric O-rings 54 are arranged between the plate 18 and the axial end wall of the body 13, for sealing the oil during delivery thereof.

A union 62 is used for introducing a lubricant oil to the sliding areas formed between the swash plate 40 and the plungers 24, and is screwed and connected to corresponding threaded hole formed in the cylinder body 13, via a through hole **10*a* formed in the housing 10. The union 62 is opened to a space formed between the body 13 and the plate 14, and supplies lubricant oil to that space. The lubricant oil as supplied to the sliding parts is recovered by a union 64 connected to the cylinder body 13, in the same way as by the first union 62**.

According to the present invention, the plungers 24 are forced into contact with the swash plate 40 by the corresponding springs 30 and are axially moved by the rotation of the swash plate 40. The minimum stroke position of a plunger 24 is obtained when the plunger 24 comes into contact with the swash plate 40 at the location of the shortest effective axial length thereof, and the maximum stroke position of a plunger 24 is obtained when the plunger 24 comes into contact with the swash plate 40 at the location of the longest effective axial length thereof. When the plunger 24 is moved to the right in FIG. 1, from the minimum stroke position to the maximum stroke position and against the force of the spring 30, the volume of the pump chamber 28 is reduced, causing the pressure of the fluid therein to be raised, whereby the delivery valve 48 is opened against the force of the spring 48-1 and allows the fluid to be delivered into the delivery chamber 51 and then to the delivery passageway 52. When the plunger 24 is moved to the left in FIG. 1, from the maximum stroke position to the minimum stroke position, by the force of the spring 30, so that the volume of the pump chamber is increased, the pressure of the fluid therein is lowered, whereby the admission valve 44 is opened against the force of the spring 44-1 and allows the fluid to be introduced into the pump chamber 42.

A mechanism for controlling a length of an effective plunger stroke in this embodiment is constructed by an annular stopper member 70 for determining the position of the plungers 24 at the ends thereof during a stroke movement adjacent to the swash plate 40. The annular stopper member 70 is slidably inserted into the cylinder body 13, and circumferentially spaced sliding pins 72 extending axially and in parallel to the axis of the shaft are connected to the annular stopper member 70. The pins 72 are slidably inserted in respective openings in the bearing plate 14, and the ends thereof are fixedly connected to the flange portion 12 of the housing 10. Springs 74 urge the annular stopper member 70 to the left of the drawing. Springs 76 are also arranged between the flange 12 and the plate 14, an adjusting plate 78 is fixed to the housing 10 at the axial end of the housing 10 opposite to the flange portion 12, and an adjusting screw 82 is screwed into the adjusting plate until the tip end thereof is in contact with the plate 19. As a result, a rotation of the screw 82 changes the position of the annular stopper member 70, and thus the effective stroke of the plungers 24 is changed as described hereinbelow.

According to this embodiment, the amount discharged from the pump is controlled by varying the axial position of the stopper member 70, to control the minimum stroke position of the plungers, 24. In the position shown in FIG. 1, where the stopper plate 70 is at the leftmost position, the plungers 24 can obtain a full stroke movement without hindrance by the stopper member 70. When the stopper plate 70 is moved to the right, as shown by an arrow 83, the flange portion 26 of the plunger 24 engages the stopper plate 70 prior to the contact of the plungers 24 with the thinnest portion 40-2 of the swash plate 40. AS a result, the minimum stroke position of the plungers is displaced to the right in FIG. 1, which reduces the effect stroke of the plungers 24. The more the stopper member is moved to the right (arrow 83 in FIG. 1), the greater the reduction of the effective stroke of the plungers. This movement of the stopper plate 70 is produced by rotating the screw member 82. Namely, when the screw member 82 is rotated, the plate 78 and the housing 10 are moved with respect to the cylinder body 13, causing the stopper plate 70 to be moved with respect to the cylinder body 13. As a result, the position of the plungers 24 when the plungers 24 are engaged with the stopper ring 70 can be varied by rotating the screw member 82.

In the embodiment shown in FIG. 1, the screw member 82 has a head portion 90 formed as a toothed wheel, which is engaged with a toothed wheel (not shown) extending from an output shaft of a rotating motor. The rotation of the motor allows a control of the stopper ring 70 to a desired axial position, whereby the stroke of the plungers 24, i.e., the amount of fluid medium discharged from the pump, can be varied.

Figure 5:
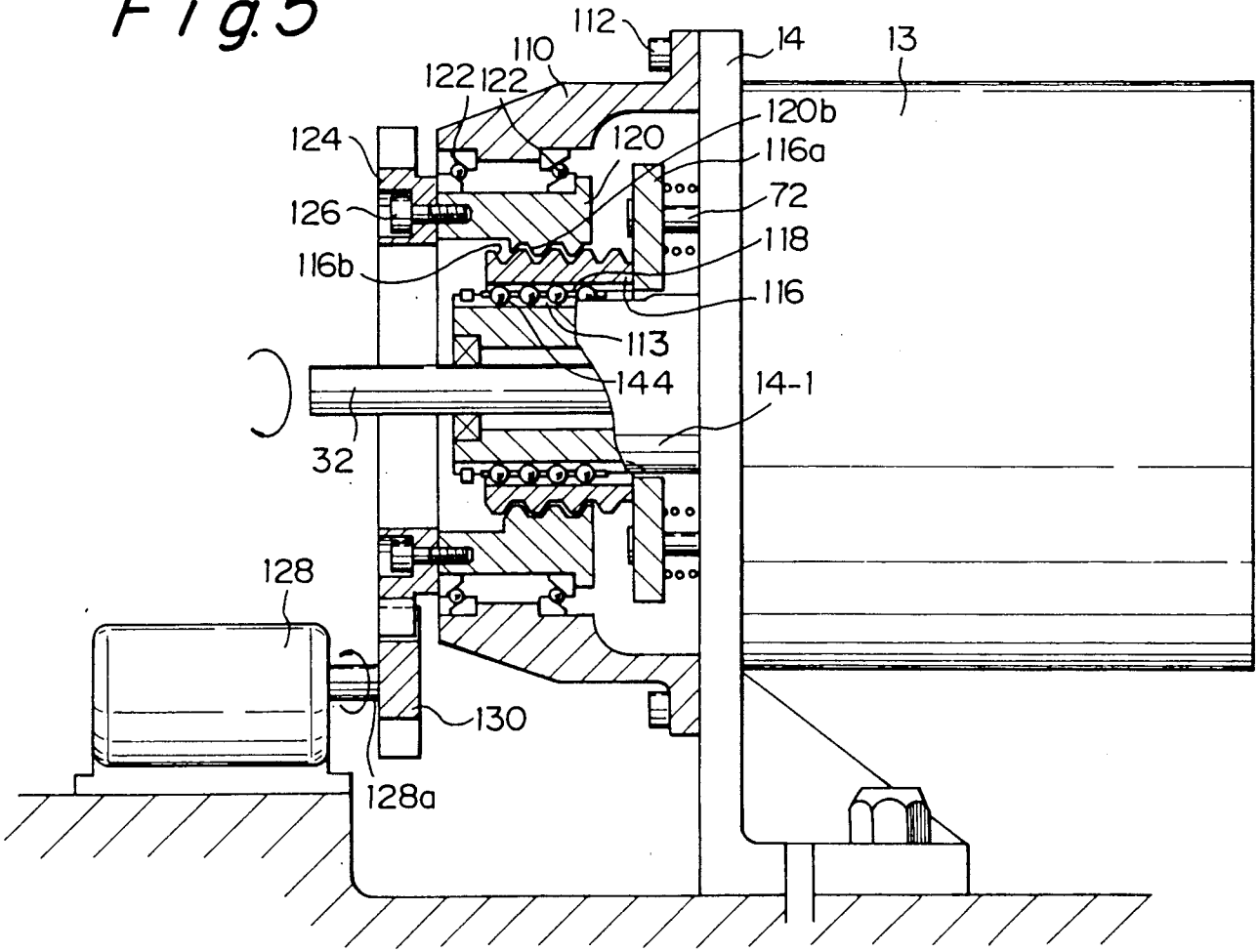
FIG. 5 is partially sectional side view of a plunger pump of the second embodiment according to the present invention.

FIG. 5 shows a second embodiment of a mechanism for controlling the movement of the stopper ring 70 to control the amount of fluid discharged from the pump. The bearing plate 14 at the end of the cylinder body 13 is fixedly connected to the housing 110 by bolts 112, and the bearing plate 14 is provided with a central boss portion 14-1 defining axially extending grooves 113 in which a plurality of balls 144 are housed, and the inner sleeve 116 forms axially extending grooves 118 with which the balls 144 also engage. One axial end of the inner sleeve 116 is provided with a flange portion **116*a* connected to the end of the rods 72**, and a screw thread 116*b* is formed on the outer surface of the inner sleeve 116, and is engaged with a screw thread 120*b* formed on the inner annular surface of the outer sleeve 120. The outer sleeve 120 is rotatably mounted to the housing 110 by a pair of axially spaced bearing units 122. An annular toothed wheel 124 is connected to one end of the outer sleeve 120 by bolts 126, and an output shaft 128*a* of an electric motor 128 is connected to a toothed wheel 130 which meshes with the toothed wheel 124.

When the electric motor 128 is operated to rotate the output shaft 128*a*, this rotation of the output shaft 128 is transmitted, via the engaging gears 130 and 124, to the outer sleeve 120. Due to the screw-like engagement of the outer sleeve 120 and the inner sleeve 116, which allows the sleeves 116 and 120 to be rotated together, and the engagement of the inner sleeve 116 with the boss portion 14-1 of the plate 14 via the axial grooves 113 and 118, and balls 144, which allows only an axial movement of the members 116 and 14-1, the rotation of the outer sleeve 120 causes the inner sleeve 116 to be moved axially without being rotated. The axial movement of the inner sleeve 116 is transmitted, via the rods 72, to a stopper member (not shown) in the housing 13, which is similar to the stopper member 70 in FIG. 1, and as a result, the minimum stroke position of the plungers is limited in accordance with the position of the rods 72, which corresponds to an angle of the rotation of the output shaft 128*a* of the electric motor 128.

Figure 7:
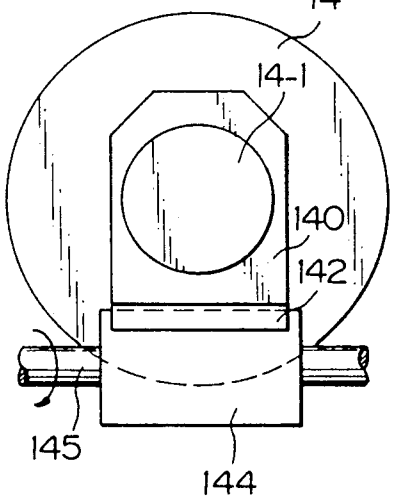
FIG. 7 is a view taken along the line VII—VII in FIG. 6.
Figure 6:
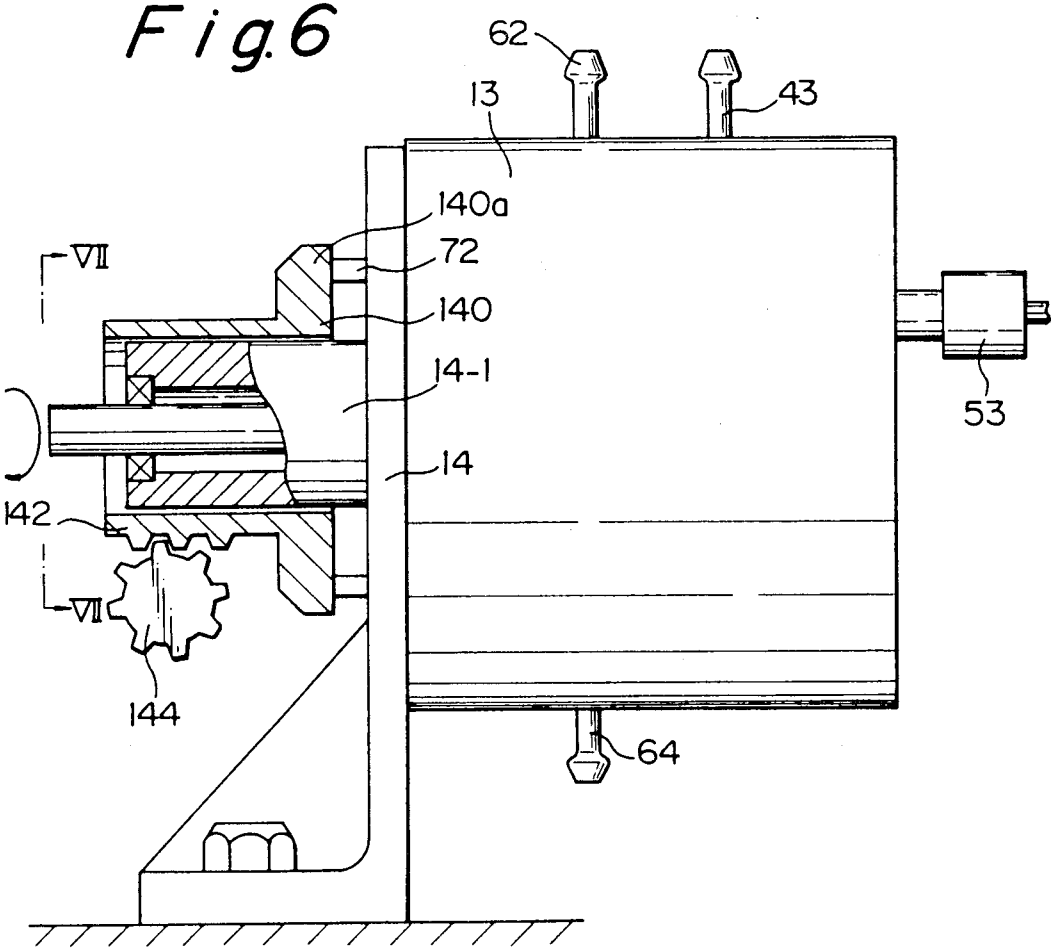
FIG. 6 is partially sectional side view of a plunger pump of a third embodiment according to the present invention.

FIGS. 6 and 7 show a third embodiment of the mechanism for controlling the position of the stopper member 70 in FIG. 7. A sleeve 140 is provided for obtaining an axial slide movement to a boss portion 14-1 of the bearing plate 14. The sleeve 140 is provided at one end with a flange portion 140*a* connected to ends of rods 72 extending from a stopper plate, not shown in FIG. 6 but arranged in the housing 13 in the same manner as in the first embodiment in FIG. 1. An outer surface of the sleeve 140 has an axially extending rack portion 142 formed thereon with which a drive gear 144 is engaged. The drive gear 144 is connected to a drive shaft 145 extended from a not shown rotary motor.

When the electric motor (not shown) is operated to rotate the pinion 144, the sleeve 140 is moved along the axial direction thereof, whereby the position of the stopper member is changed, and thus the amount of fluid output from the pump is varied.

Figure 8:
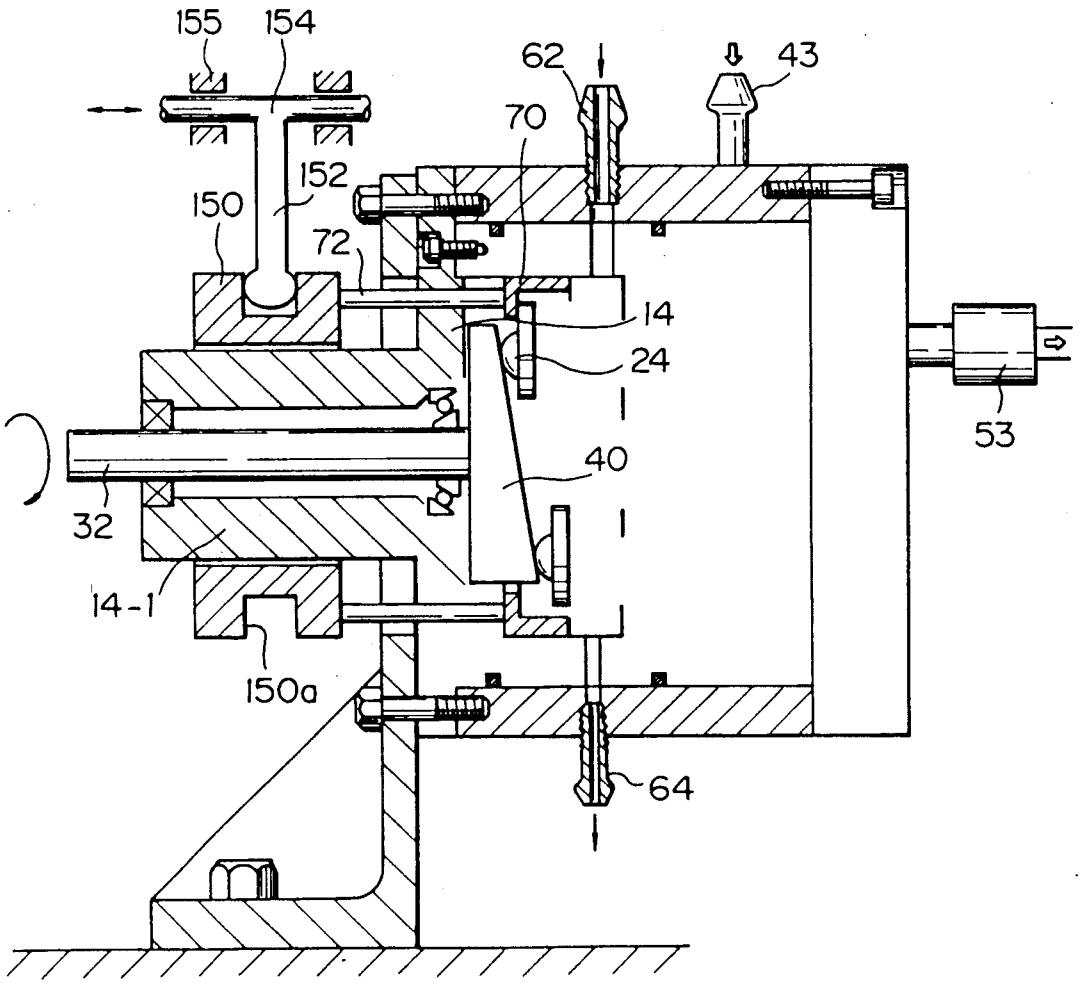
FIG. 8 is partially sectional side view of a plunger pump of a fourth embodiment according to the present invention.

Another embodiment is shown in FIG. 8, wherein a sleeve 150 is axially and movably mounted to the boss portion 14-1 of the bearing plate 14. The sleeve 150 is connected to the annular stopper member 70 via rods 72, and forms an annular groove 150*a* with which one end of an operating lever 152 is engaged. The other end of the lever 152 is connected to a rod 154 which is axially and slidably mounted to a pair of axially spaced apart supporting portions 155. The sliding rod 154 is connected to a not shown fluid pressure cylinder. The fluid pressure cylinder allows the rod 154 to be axially moved, and this movement is transmitted, via the lever 152, sleeve 150, and rods 72, to the stopper 70, so that the position of the plungers 24 at which they come into contact with the stopper 70 is varied, whereby the amount of fluid output from the pump is varied.

As clear from the above description, according to the present invention, a stopper is provided for engagement with portions of the plungers near the swash plate, to limit a stroke of the plungers regardless of the movement of the swash plate, to control the angle of inclination thereof with respect to the pump axis and thereby control the amount of fluid discharged therefrom. Namely, a control of the stopper plate for controlling an axial position of the plungers allows the plunger stroke to be controlled, and as a result, a construction in which little wear occurs is realized, and thus a prolonged and reliable operation is obtained. Furthermore, an intrinsic advantage of the rotary swash plate type pump of a small mass of the moving parts of the pump, because the cylinder is not rotated, can be maintained at the same degree as that obtained in the prior art.

Although the present invention is described with reference to the attached drawings, many modifications and changes can be made by those skilled in this art without departing from the scope and spirit of the invention.

We claim:

1. An axial plunger pump, comprising:

a stationary body and a shaft rotatably arranged in the body;

said body defining cylinder bores which are circumferentially spaced about an axis of the shaft, each cylinder bore defining an axis which is parallel to the axis of the shaft;

plungers axially and slidably inserted in the respective cylinder bores, so that the pump chambers are formed on one side of the plungers in the respective cylinder bores;

a swash plate on the shaft defining an operating surface inclined with respect to the axis of the shaft, the ends of the plunger being remote from the respective pump chamber coming into contact with the operating surface so that the plungers are axially moved between opposite extreme positions to thereby vary the volume of the chamber;

means for allowing a fluid to be introduced into the pump chamber when the plunger is moved in a direction in which a volume of the pump chamber is increased;

means for allowing the fluid to be discharged from the pump chamber when the plunger is moved in an opposite direction in which the volume of the pump chamber is reduced; and means for limiting the extreme positions of the plungers adjacent to the swash plate to thereby vary the amount of fluid discharged from the pump chambers, said limiting means limiting the positions of the plungers independently of the swash plate.

2. An axial plunger pump according to claim 3, wherein said stopper member is formed as an annular member slidably inserted to the body, and wherein each of the plungers defines at one end thereof adjacent to the swash plate a flange portion which cooperates with the annular member for limiting the axial movement thereof.

3. An axial plunger pump according to claim 1, wherein said limiting means comprise a stopper member which is axially slidable with respect to the body, said stopper member cooperating with the plungers to limit the movement of the plungers in the direction in which the volume of the pump chambers is increased, and actuator means connected to the stopper member for obtaining a desired axial location of the stopper member for obtaining a desired amount of fluid discharge from the pump chambers.

4. An axial plunger pump according to claim 3, wherein said actuator means comprises a slide member which is axially slidable with respect to the body and connected to the stopper member, and means connected to the slide member for generating the axial movement of the slide member.

5. An axial plunger pump according to claim 4, wherein said generating means comprise a rotating motor, and a toothed member connected to the rotating member, the sleeve member having an axially extended rack portion with which said toothed member is engaged so that the rotational movement from the motor is transformed to an axial movement of the sleeve member, which is transmitted to the stopper plate.

6. An axial plunger pump according to claim 4, wherein said generating means comprise a linear motor, and connecting means for connecting the linear motor to the sleeve member for transmitting the linear movement from the linear motor to the sleeve member.

7. An axial plunger pump according to claim 4, wherein said generating means comprise a rotating motor, and means arranged between the rotating motor and the slide member for converting the rotational movement from the rotating motor to the axial movement of the slide member.

8. An axial plunger pump according to claim 7, wherein said converting means comprise a rotating member connected to the motor, and a plate member connected to the stopper plate, said rotating member being screw-connected to the plate member, said rotating member having an end coming into contact with the body so that the rotational movement of the rotating member is transformed into an axial movement of the plate member, which is transmitted to the stopper member.

9. An axial plunger pump according to claim 7, wherein said converting means comprise a rotating member connected to the motor, and a plate member connected to the stopper plate, and means for allowing an axial sliding movement of the sleeve on the body while a mutual rotation of the sleeve and the body is prohibited, the rotating member being screw-engaged with the sleeve member so that the rotation of the rotating member is transformed to the axial movement of the sleeve member.

* * * * *

UNITED STATES PATENT AND TRADEMARK OFFICE

CERTIFICATE OF CORRECTION

PATENT NO. : 5,061,155

DATED : October 29, 1991

INVENTOR(S) : Masaoka Toshika, et. al.

It is certified that error appears in the above-identified patent and that said Letters Patent is hereby corrected as shown below:

| Column | Line | |
|---|---|---|
| 1 | 65 | After "defining" change "a" to --an--. |
| 2 | 19 | Before "side" change "an" to --a--. |
| 3 | 16 | After "connected to" change "a" to --an--. |
| 3 | 34 | After "connected to" insert --a--. |
| 4 | 31 | Change "plate 70" to --member 70--. |
| 4 | 33 | Change "plate 70" to --member 70--. |
| 4 | 41 | Change "plate 70" to --member 70--. |
| 4 | 44 | Change "plate 70" to --member 70--. |
| 4 | 47 | Change "ring 70" to --member 70--. |
| 4 | 54 | Change "ring 70" to --member 70--. |
| 4 | 58 | Change "ring 70" to --member 70--. |
| 5 | 43 | Change "pinion 144" to --drive gear 144--. |

Signed and Sealed this

Twenty-fifth Day of May, 1993

*Attest:*

Michael K. Kirk

MICHAEL K. KIRK

*Attesting Officer*

*Acting Commissioner of Patents and Trademarks*